US011040863B2

(12) United States Patent
Sonnenrein

(10) Patent No.: US 11,040,863 B2
(45) Date of Patent: Jun. 22, 2021

(54) METHOD FOR DRAWING A CARBONATED DRINK, DISPENSER SYSTEM FOR CARBONATED DRINKS AND CARTRIDGE UNIT FOR SAME

(71) Applicant: Gerrit Sonnenrein, Fürstenwalde (DE)

(72) Inventor: Gerrit Sonnenrein, Fürstenwalde (DE)

( * ) Notice: Subject to any disclaimer, the term of this patent is extended or adjusted under 35 U.S.C. 154(b) by 117 days.

(21) Appl. No.: 16/338,858

(22) PCT Filed: Sep. 25, 2017

(86) PCT No.: PCT/EP2017/074264
§ 371 (c)(1),
(2) Date: Apr. 2, 2019

(87) PCT Pub. No.: WO2018/065253
PCT Pub. Date: Apr. 12, 2018

(65) Prior Publication Data

US 2020/0172386 A1 Jun. 4, 2020

(30) Foreign Application Priority Data

Oct. 6, 2016 (DE) ..... 10 2016 119 010.1

(51) Int. Cl.

| | |
|---|---|
| ***B67D 1/04*** | (2006.01) |
| ***B67D 1/12*** | (2006.01) |
| *B67D 1/14* | (2006.01) |
| *B67D 1/00* | (2006.01) |

(52) U.S. Cl.
CPC ..... *B67D 1/0406* (2013.01); *B67D 1/1252* (2013.01); *B67D 1/127* (2013.01); *B67D 1/1411* (2013.01); *B67D 2001/009* (2013.01); *B67D 2001/1261* (2013.01); *B67D 2210/00007* (2013.01)

(58) Field of Classification Search
CPC ..... B01D 35/02; B01D 35/04–046; B67D 1/0406; B67D 1/1411; B67D 1/1422; B67D 1/12; B67D 1/1252; B67D 1/1272; B67D 2210/0001
See application file for complete search history.

(56) References Cited

U.S. PATENT DOCUMENTS 2,450,564 A 2/1951 Zacko

FOREIGN PATENT DOCUMENTS

| | | | |
|---|---|---|---|
| JP | 2002 273417 | A | 9/2002 |
| JP | 2015 182061 | A | 10/2015 |
| WO | WO2007/141339 | A1 | 12/2007 |
| WO | WO2012/150465 | A1 | 11/2012 |

OTHER PUBLICATIONS

International Search Report issued by the European Patent Office in International Application PCT/EP2017/074264.

*Primary Examiner* — Paul R Durand
*Assistant Examiner* — Randall A Gruby
(74) *Attorney, Agent, or Firm* — Ursula B. Day, Esq.

(57) ABSTRACT

The invention relates to a method for drawing a carbonated drink from a dispenser system, in which the carbonated drink is conducted via a line through a flow controller and a filter that is downstream of said flow controller. The invention also relates to a dispenser system and to a cartridge unit comprising a filter.

23 Claims, 1 Drawing Sheet

METHOD FOR DRAWING A CARBONATED DRINK, DISPENSER SYSTEM FOR CARBONATED DRINKS AND CARTRIDGE UNIT FOR SAME

CROSS-REFERENCES TO RELATED APPLICATIONS

This application is the U.S. National Stage of international Application No. PCT/EP2017/074264, filed Sep. 25, 2017, which designated the United States and has been published as International Publication No. WO 2017/065253 A1 and which claims the priority of German Patent Application, Serial No. 10 2016 119 010.1, filed Oct. 6, 2016, pursuant to 36 U.S.C. 119(a)(d).

BACKGROUND OF THE INVENTION

The present invention relates to a method for drawing a carbonated drink, a dispenser system for carbonated drinks and a cartridge unit for carbonated drinks.

Conventional table water devices with a mechanical or electromechanical tap, such as, for example, beer dispensing systems, in which the flow rate is adjusted by means of a compensator, are known from the prior art. For example, EP 1926548, which is considered to a generic example, discloses that the flow rate can also be adjusted with a commercially available flow regulator. However, significant $CO_2$ loss has been shown to occur due to the sudden relaxation to ambient pressure in the flow regulator.

Likewise, the use of filters or terminal filters, which may also be designed as membrane filters, is known. These filters are used to prevent retrograde contamination of dispensers. Since the pressure drop increases with the duration of use of the filter and thus reduces the flow rate, such filters are nowadays always oversized so that there is no significant reduction in the flow rate during the recommended service life. Compensators continue to be used for the actual flow control. The pressure drop of the filters and membrane filters used in the prior art approaches zero at the set flow rate and is significantly less than 1 bar.

SUMMARY OF THE INVENTION

It is an object of the present invention to provide an improved variant of a dispensing system, which can be used to draw carbonated drinks and to simultaneously prevent retrograde contamination of the system.

This object is achieved with a method for drawing a carbonated drink from a dispensing system including the carbonated drink being passed by way of a line through a flow regulator and a filter arranged downstream of the flow regulator, wherein the carbonated drink experiences a pressure drop when passing through the filter, with the pressure drop being greater than the equilibrium pressure of the barbonated drink; and by a dispensing system for carbonized drinks that includes a line having a flow regulator and a filter disposed downstream of the flow regulator, configured to pass a carbonated drink via the line through the flow regulator and the filter, wherein the filter is constructed such that the carbonated drink experiences a pressure drop that is greater than the equilibrium pressure of carbonated drink, when the carbonated drink flows through the filter; as well as a cartridge unit for a dispensing system for carbonated drinks with a flow regulator and a filter configured to pass the carbonated drink through the flow regulator and the filter, wherein the filter is arranged downstream of the flow regulator, and wherein the filter is constructed to relax a carbonated drink, when the carbonated drink flows through the filter.

Advantageous further embodiments are each recited in of the dependent claims. All combinations as well as only individual combinations between the method, the dispensing system and the cartridge unit can be used.

Furthermore, it is also provided and possible to combine one or more features of the method, the dispensing system or the cartridge unit as desired.

According to the invention, a method for drawing a carbonated drink from a dispensing system is proposed, wherein the carbonated drink is passed via a line through a flow regulator and a flow regulator downstream of the flow regulator, wherein when flowing through the filter, the carbonated drink undergoes a pressure drop which is greater than the equilibrium pressure of the carbonated drink.

Carbonated drinks are under pressure before they are dispensed. They are, for example, pre-carbonated and stored in special containers under pressure so as to prevent the $CO_2$ from escaping before dispense. Optionally, carbonated drinks are mixed and carbonated just prior to drawing. However, a specific pressure is necessary to cause the $CO_2$ to dissolve in the drink, which depends on the following conditions: the temperature, the $CO_2$ content and the type of drink. In any case, in a dispensing system a carbonated drink is under a specific pressure that exceeds ambient pressure. At or just before the tap, the drink must be relaxed to ambient pressure.

In the context of the generic method, the relaxation of the carbonated drink takes place essentially in the flow regulator and thus abruptly. This may cause the $CO_2$ content of the carbonated drink to drop abruptly to ambient pressure as it passes through the flow regulator and thus to outgas $CO_2$ to a relevant extent, since the equilibrium pressure of $CO_2$ in water is above ambient pressure.

The invention is now based on the recognition that because the filter is arranged downstream of the flow regulator, back pressure is generated downstream of the flow regulator, which causes the carbonated drink passing through the flow regulator not to relax to ambient pressure, but to the sum of ambient pressure and back pressure. This fact is advantageously used by the invention in that the fitter is deliberately sized so as to always generate a back pressure during flow through the filter such that the sum of the ambient pressure and back pressure is above the equilibrium pressure of the $CO_2$ in the carbonated drink at its actual temperature. Thus, the equilibrium pressure of $CO_2$ dissolved in water at 8° C. is approximately 1.6 bar. Therefore, at an ambient pressure of 1 bar, a back pressure of more than 0.6 bar resulting from the flow through the filter is still required in order to prevent a sudden relaxation of the carbonated liquid in the flow regulator to a pressure which is below the equilibrium pressure of the $CO_2$ dissolved in the carbonated liquid. This can be realized in a simple manner by selecting and suitable sizing the filter.

The filter may be collocated with the tap or be located directly upstream of the tap.

The employed filter may advantageously be a filter that is suitable for sterilizing or for sterile filtration, so as to prevent the retrograde contamination of the dispensing system.

In a particularly preferred embodiment, so-called dead-end filters are used in conjunction with the present invention. With dead-end filtration, a feed is pumped against the filter, with the so-called permeate draining from the back side of the filter. The use of "dead-end" filters is advantageous since these filters can be easily constructed so as to be suitable for sterilizing the filtered liquid. The use of such filters makes it possible to reliably prevent retrograde contamination of the dispensing system.

Dead-end filtration is to be distinguished from the so-called tangential flow filtration, which, however, can also be used in conjunction with the present invention.

It has been found that filters based on fiber membranes are particularly suitable dead-end filters. Such filters may be formed as a flat filter; however, filters based on hollow fiber membranes are preferably used in conjunction with the present invention. Filters based on fiber membranes are commercially available at low cost in a variety of designs.

In a preferred embodiment, the filter provided according to the invention has pores with a size between 100 and 300 nanometers, preferably between 150 and 200 nanometers.

During the dispensing process, a carbonated drink is passed within the dispensing system through the line, the flow regulator and the filter. It is contemplated that the line passes the carbonated drink through the flow regulator and the filter. These components may be formed either integrally with the line, or alternatively, the flow regulator and/or the filter may be formed as separate components and then separately connected to the line.

Furthermore, the flow regulator and the filter may be integrally formed and connected to the line as an integral component.

The carbonated drink has an equilibrium pressure for the dissolved $CO_2$. In order to tap a carbonated drink, the drawing process and/or the relaxation of the carbonated drink to ambient pressure must be relatively slow. It is also necessary that during the drawing process, the pressure drop experienced by the drink is above the equilibrium pressure of the carbonated drink when changing from the compressed state in the drawing system to a non-compressed state under normal conditions. Therefore, this pressure drop must be greater than the equilibrium pressure of the carbonated drink.

The flow rate of the carbonated drink through the line is adjusted with the flow regulator to approximately 1 to 3 L/min. Preferably, the flow rate is set to approximately 2 L/min. The indication "approximately" In this context is meant to indicate a deviation of ±10% of the flow rate. The flow rate can be held constant with the flow regulator.

In another embodiment of the method, the carbonated drink has, for example, a temperature between 1° C. and 12° C., when passing through the filter. Preferably, a carbonated drink has a temperature between 4° C. and 10° C.

Basically, all temperatures are feasible at which a carbonated drink can be passed through the filter and be relaxed there. Experience has shown that chilled drinks are served at temperatures between 6° C. and 8° C. Deviations of ±10° are common.

In another embodiment, a drink may also be dispensed at ambient temperature.

In another embodiment of the method according to the invention, the pressure drop is greater than 1 bar for a drink having a temperature of 10° C. and a $CO_2$ content of 6 g/L $CO_2$.

In another embodiment of the method, the carbonated drink is cooled before being passed through the flow regulator and the filter. For this purpose, a dispensing system may include a cooling system.

In another embodiment, the flow regulator and the filter are arranged in a cartridge unit. Optionally, the cartridge unit can be designed in one piece, and the flow regulator and the filter may be an integral part of the cartridge unit.

In another embodiment, the carbonated drink is passed through a valve constructed to close the line, preferably through a low-turbulence valve.

Additionally or separately, the valve may include a plug valve or a ball valve with or without drip protection. Furthermore, the valve may be arranged on the line or at the tap. Furthermore, a valve for closing the line may be arranged upstream of the flow regulator, and a valve, for example with drip protection, may be disposed on the end of the tap.

In another embodiment, a valve with a safety valve and/or pressure-sustaining valve may be connected downstream of the filter and attached to the line or to the tap.

Additionally or separately from the method discussed above, according to another aspect of the invention, a dispensing system for a carbonated drink is proposed, with a line with a flow regulator and a filter disposed downstream of the flow regulator. In this case, the dispensing system is set up such that a carbonated drink can be passed via the line through the flow regulator and the filter, wherein the filter is constructed such that the carbonated drink experiences a pressure drop that is greater than the equilibrium pressure of the carbonated drink flowing through the filter.

A dispensing system may have a storage tank for carbonated drinks. Such a storage tank is hereby provided with a line through which the carbonated drink is passed to a tap of the dispensing system. The carbonated drink passes through the flow regulator and the filter before reaching the tap. The flow rate is set at the flow regulator, and the carbonated drink is relaxed and sterile filtered in the filter, thereby preventing retrograde contamination of the dispensing system.

In another embodiment of the dispensing system, the flow rate of the carbonated drink is adjustable with the flow regulator to approximately 1 to 3 L/min., preferably to approximately 2 L/min. The term "approximately" Is meant to indicate deviations in the range of ±10% of the flow rate.

In another embodiment, the dispensing system has a cooling system for the carbonated drink.

Cooling is not absolutely necessary. However, carbonated drinks are preferably consumed by a consumer at a temperature between 6° C. and 8° C.

It is also possible to draw carbonated drinks at ambient temperature.

In another embodiment, the filter is configured such that the pressure drop of the carbonated drink at 10° C., when passed through the filter, is above 1 bar. The $CO_2$ content of the carbonated drink is then 6 g $CO_2$/L.

In another embodiment, the dispensing system has a cartridge unit which includes the flow regulator and the filter.

The flow regulator and the filter can be individual components. These may be either integrally formed with the line or individually connected to the line.

Furthermore, the cartridge unit may include the two components flow regulator and filter as individual components or as the cartridge unit of the flow regulator, and the filter may be designed as an integral component.

Furthermore, it is possible and conceivable to configure the flow regulator and the filter together as an integral component.

In another embodiment, the cartridge unit may be exchangeable.

Optionally, both the flow regulator and the filter may be exchangeable. Furthermore, the flow regulator and filter may be designed as an integral exchangeable component.

In another embodiment, the dispensing system has a valve for closing the line, preferably a low-turbulence valve.

Furthermore, the dispensing system may have a ball valve or a conical valve, optionally with drip protection. Such a cone valve with or without drip protection may be arranged at the end of the tap.

A valve may be installed on the line, for example, upstream of a flow regulator.

In another embodiment, a valve in combination with a safety/pressure valve may be connected downstream of a filter and mounted on the line downstream of the filter.

According to a further aspect of the invention, additionally or separately, a cartridge unit for a carbonated drink dispenser is proposed which includes a flow regulator and a filter. The cartridge unit is constructed such that the carbonated drink can pass through the flow regulator and the filter, wherein the filter is disposed downstream of the flow regulator and wherein the filter is constructed to relax a carbonated drink as it flows through the filter.

According to another embodiment, the filter is arranged to relax the carbonated drink so that it experiences a pressure drop that is greater than the equilibrium pressure of the carbonated drink as it flows through the filter.

In another embodiment, the flow regulator is constructed to set a constant flow rate of the carbonated drink of approximately 1 to 3 L/min., in particular of approximately 2 L/min. The term "approximately" is meant to indicate deviation of +10% of the flow rate.

According to another embodiment, the filter is constructed such that the pressure drop of the carbonated drink passing through the filter is greater than 1 bar at a flow rate of 2 l/min, and a $CO_2$ content of 6 g $CO_2$/L at 10° C.

In the context of the aforedescribed method, the dispensing system and the cartridge unit, carbonated drinks with a $CO_2$ content higher or lower than approximately 6 g $CO_2$/L can also be drawn. For example, for drinks labeled as "medium", such as table water or other low-carbonated drinks, $CO_2$ levels of approximately 3 g $CO_2$/L are common. However, drinks with a higher $CO_2$ content can also be served. For example, for strongly carbonated soft drinks, refreshment drinks or cola, a $CO_2$ content of approximately 7 to 8 g $CO_2$/L is common. Here, variations in the $CO_2$ content of 20% based on the $CO_2$ content are common.

Further advantageous embodiments and developments are specified in the following exemplary embodiments, which will be explained with reference to the accompanying figures. However, the features described in the embodiments are not limited to the features shown in the respective exemplary embodiment. Rather, one or more features of the above description may be combined with one or more features of the following exemplary embodiments to provide advantageous refinements.

DETAILED DESCRIPTION OF PREFERRED EMBODIMENTS

Figures 1, 2:
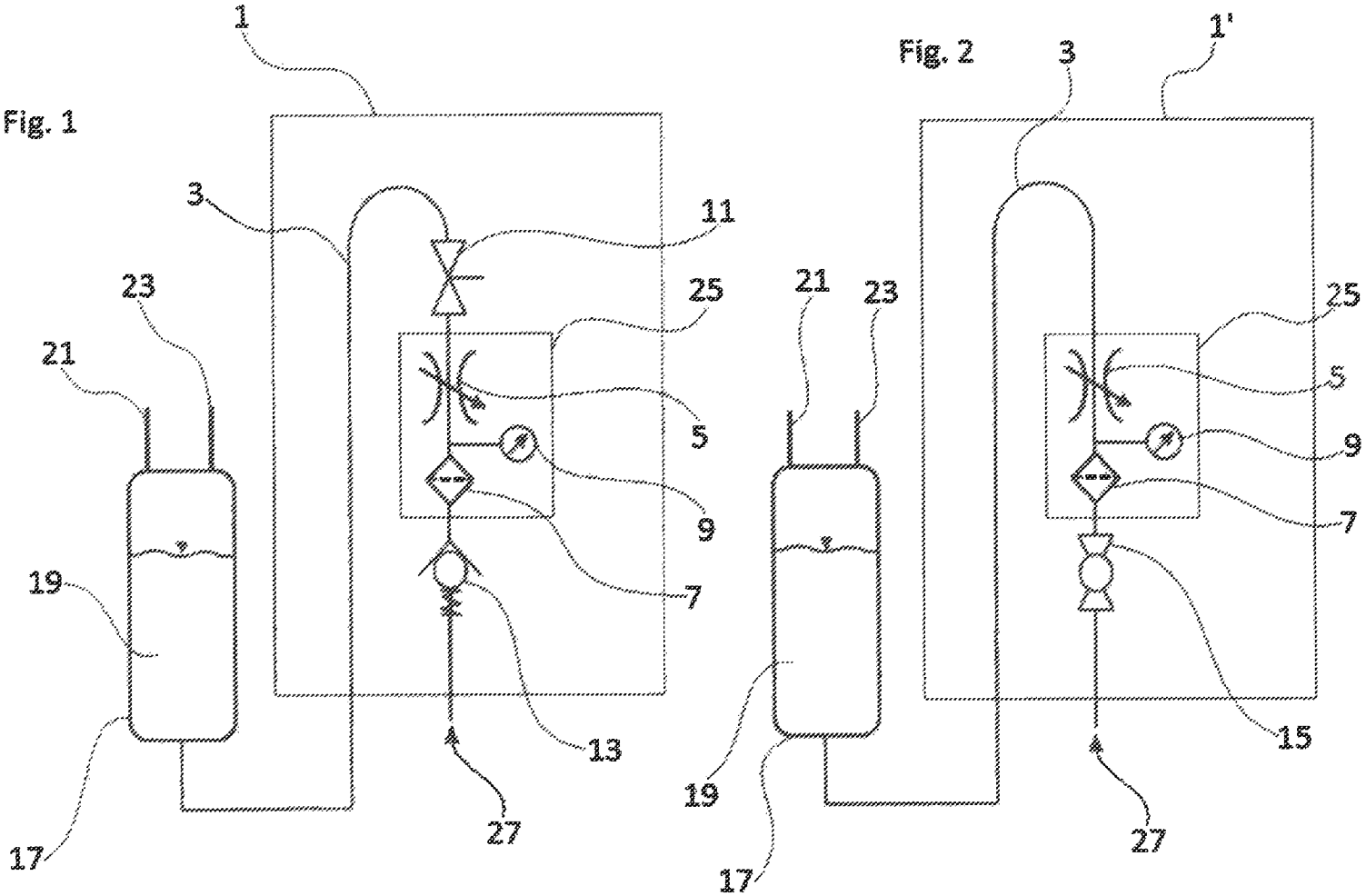
FIG. 1: shows a first embodiment of a dispensing system.
FIG. 2: shows another embodiment of a dispensing system.

Like reference numerals in the two exemplary embodiments indicate identically designed components.

FIG. 1 shows a first exemplary embodiment of a dispensing system 1 according to the invention. The dispensing system 1 in this case has a line 3 and a flow regulator 5 and a filter 7. The line 3 of the dispensing system 1 is connected to a storage tank 17 for a carbonated drink 19. The carbonated drink 19 in the storage tank is under pressure. Moreover, the storage tank 17 also has a supply line 21 for water and a supply line 23 for $CO_2$.

The filter 7 is constructed as a dead-end filter and is based on a bundle of several hollow-fiber membranes having pores with a size between 150 and 200 nanometers. Such filters allow sterile filtration and thus prevent retrograde contamination of the dispensing system from a tap 27.

The carbonated drink 19 is passed through the line 3 through the flow regulator 5 and the filter 7 and can then be drawn at a tap 27. For monitoring the pressure control and the flow rate, the dispensing system 1 also has a pressure indicator 9. This is only an optional feature which can, for example, be omitted in end customer equipment for cost reasons.

Moreover, a valve 11 is provided upstream of the flow regulator 5 for the purpose of closing the dispensing system 1, for example, for maintenance or while it is not in operation. With this valve 11, the line 3 can be closed and opened. A cartridge unit 25 (indicated by dashed lines) in which the flow regulator 5 and the filter 7 are arranged is provided. Furthermore, the pressure indicator 9 is also arranged in the cartridge unit 25. Optionally, however, a cartridge unit 25 without a pressure indicator 9 may be provided. The dispensing system 1 also has a cone valve 13 as drip protection.

Furthermore, the storage tank 17 for carbonated drinks 19 may optionally be integrated directly into the dispensing system 1. Moreover, in each case, for example, new containers may be connected to the line 3, as is done for example in operations when drinks are housed in barrels.

FIG. 2 shows another embodiment of a dispensing system 1 according to the invention. This embodiment has a storage tank 17 for carbonated drinks 19 and a connection 21 for water and a connection 23 for $CO_2$. The carbonated drink 19 is passed through the line 3 through a flow regulator 5 and a filter 7. In the filter 7, the carbonated drink 19 is relaxed to ambient pressure and experiences here a pressure drop that is greater than the equilibrium pressure of the carbonated drink 19. The flow regulator 5 and the filter 7 together with a pressure gauge 9 are arranged in a cartridge unit 25. A valve 15 with a safety/pressure valve is arranged downstream of the cartridge unit 25 and the filter 7. This valve 15 with safety/pressure valve can be used to open and close the line 3 of the dispensing system 1'.

What is claimed is:

1. A method for drawing a carbonated drink from a dispensing system, wherein the carbonated drink is passed by way of a line through a flow regulator and a filter arranged downstream of the flow regulator, wherein the carbonated drink undergoes a pressure drop when passing through the filter, with the pressure drop being greater than the equilibrium pressure of the carbonated drink.

2. The method according to claim 1, wherein the flow rate is set by the flow regulator to 1-3 L/min.

3. The method according to claim 1, wherein the carbonated drink has a $CO_2$ content of 3-8 g $CO_2$/L.

4. The method according to claim 1, wherein the carbonated drink has a temperature between 1° C. and 12° C. when passing through the filter.

5. The method according claim 1, wherein the pressure drop at 10° C. is greater than 1 bar.

6. The method according to claim 1, wherein the flow regulator and the filter are arranged in a cartridge unit.

7. The method according to claim 1, wherein the carbonated drink is passed through a valve for closing the line.

8. The method according to claim 7, wherein the valve is a low-turbulence valve.

9. The method according to claim 7, wherein the valve is arranged downstream of the filter.

10. The dispensing system according to claim 9, wherein a flow rate of the carbonated drink is adjustable with the flow regulator to 1-3 L/min, or to approximately 2 L/min.

11. The dispensing system according to claim 9, wherein the dispensing system comprises a cooling system.

12. The dispensing system according to one of claim 9, wherein the dispensing system comprises a cartridge unit which includes the flow regulator and the filter.

13. The dispensing system according to claim 12, wherein the cartridge unit is exchangeable.

14. A dispensing system for carbonate drinks, comprising, a line having a flow regulator and a filter disposed downstream of a flow regulator, and configured to pass a carbonated drink via the line through the flow regulator and the filter, wherein the filter is constructed such that the carbonated drink undergoes a pressure drop that is greater than the equilibrium pressure of the carbonated drink, when the carbonate drink flows through the filter.

15. The dispensing system according to claim 14, wherein the filter is constructed such that the pressure drop of the carbonated drink at 10° C. is greater than 1 bar.

16. The dispensing system according to claim 14, wherein the dispensing system has a valve for closing the line.

17. The dispensing system according to claim 16, wherein the valve is arranged downstream of the filter.

18. The dispensing system according to claim 17, wherein the valve comprises a safety valve or a pressure-sustaining valve.

19. The dispensing system according to claim 16, wherein the valve is arranged upstream of the flow regulator.

20. The dispensing system according to claim 19, further comprising a ball valve or a cone valve, which is arranged on the line downstream of the filter.

21. A cartridge unit for use in the method according to claim 1, comprising a flow regulator and a filter configured to pass the carbonated drink through the flow regulator and the filter, wherein the filter is arranged downstream of the flow regulator, and wherein the filter is constructed to relax a carbonated drink when the carbonated drink flows through the filter such that carbonated drink undergoes a pressure drop that is greater than the equilibrium pressure of the carbonated drink flowing through the filter.

22. The cartridge unit according to claim 21, wherein flow regulator is configured to set a constant flow rate of the carbonated drink of 1-3 l/min.

23. The cartridge unit according to claim 21, wherein the filter is constructed for a pressure drop of the carbonated drink flowing through the filter is greater than bar at a flow rate of 2 l/min and a carbon dioxide content of 6 g $CO_2$/l at 10° C.

* * * * *